US007007823B2

(12) United States Patent
Jackson

(10) Patent No.: US 7,007,823 B2
(45) Date of Patent: Mar. 7, 2006

(54) TOOTHPASTE DISPENSING SYSTEM

(76) Inventor: Mark Jackson, 131-10 Guy Brewer Blvd., Jamaica, NY (US) 11434

( * ) Notice: Subject to any disclaimer, the term of this patent is extended or adjusted under 35 U.S.C. 154(b) by 0 days.

(21) Appl. No.: 10/901,329

(22) Filed: Jul. 29, 2004

(65) Prior Publication Data

US 2005/0029294 A1 Feb. 10, 2005

Related U.S. Application Data

(60) Provisional application No. 60/492,293, filed on Aug. 5, 2003.

(51) Int. Cl.
*B65D 35/032* (2006.01)

(52) U.S. Cl. ..... 222/99; 222/215

(58) Field of Classification Search ..... 222/92–107, 222/215

See application file for complete search history.

(56) References Cited

U.S. PATENT DOCUMENTS

| | | | | |
|---|---|---|---|---|
| 3,160,323 | A * | 12/1964 | Weisberg | 222/107 |
| 3,211,342 | A * | 10/1965 | Miles | 222/107 |
| 4,807,782 | A | 2/1989 | Meinerding et al. | |
| 4,997,107 | A | 3/1991 | Snyder et al. | |
| 5,048,725 | A | 9/1991 | Peterson | |
| 5,082,144 | A | 1/1992 | Sundstrom | |
| 5,373,968 | A * | 12/1994 | Nelson | 222/99 |
| 5,442,839 | A | 8/1995 | Miller | |
| 5,732,854 | A | 3/1998 | Ruben et al. | |
| 5,782,385 | A | 7/1998 | Soon | |
| 5,884,812 | A | 3/1999 | Stawowski | |
| 5,920,967 | A | 7/1999 | Souza | |
| 6,332,560 | B1 * | 12/2001 | Rosenberg | 222/107 |
| 6,415,479 | B1 | 7/2002 | Steinberg | |
| 2001/0040172 | A1 | 11/2001 | Pirrallo | |

FOREIGN PATENT DOCUMENTS

| | | |
|---|---|---|
| JP | 8038382 | 2/1996 |
| WO | WO 86/01178 | 2/1986 |

* cited by examiner

*Primary Examiner*—Michael Mar
*Assistant Examiner*—Melvin A. Cartagena
(74) *Attorney, Agent, or Firm*—Richard C. Litman

(57) ABSTRACT

The toothpaste dispensing system includes a toothpaste tube and a pair of mating hook and loop fastening strips affixed to opposing surfaces of the toothpaste tube. When the bottom end of the tube is rolled up to dispense toothpaste, the mating hook and loop strips from opposing tube surfaces interlock. Consequently, the emptied, folded portions of the tube are held together, facilitating efficient dispensing of the toothpaste. The hook and loop strips may be permanently affixed to the toothpaste tube, or removably affixed for re-use with multiple tubes.

2 Claims, 3 Drawing Sheets

TOOTHPASTE DISPENSING SYSTEM

CROSS-REFERENCE TO RELATED APPLICATION

This application claims the benefit of U.S. Provisional Patent Application Ser. No. 60/492,293, filed Aug. 5, 2003.

BACKGROUND OF THE INVENTION

1. Field of the Invention

The present invention relates generally to toothpaste tubes. More specifically, the invention is a toothpaste tube having hook and loop strips positioned longitudinally on opposite sides of a toothpaste tube to facilitate holding the emptied portion of a toothpaste tube in a folded position.

2. Description of the Related Art

The related art of interest describes various devices to control the coiling of a tube as its content is being dispensed. However, there still remains a need for a device which prevents emptied, coiled portions of a plastic toothpaste tube from uncoiling, and which is simple to use and inexpensive to manufacture and produce. The present invention fulfills this need by providing a toothpaste tube having hook and loop fastener strips strategically disposed on opposite surfaces. The references will be discussed in the order of perceived relevance to the present invention.

U.S. Pat. No. 5,048,725 issued on Sep. 17, 1991, to Mildred I. Peterson describes a wall mountable toothpaste dispenser with a tube winder knob that extends through channels of a container. A tube may be inserted into the container and wound onto the rod. Bondable strips may be positioned on opposites surfaces of the tube so that when the tube is being wound, the bondable strips engage one another and squeeze the sides of the tube together. When the bondable strips are engaged in this manner, unwinding of the tube is also prevented. The bondable strips may be magnetic strips or strips made from hook and loop material. The toothpaste dispenser disclosed in Peterson, however, includes numerous parts and requires a user to expend a great deal of time and effort in assembling the tube within the container and manipulating the tube winder knob in order to dispense toothpaste from the tube. The present invention, on the other hand, includes only a tube of toothpaste and mating strips of hook and loop material. Toothpaste may be dispensed from the tube of the present invention by merely grasping the sides of the tube and coiling the tube from its bottom end as the toothpaste is dispensed. Thus, the toothpaste tube of the present invention is simpler, more convenient, and at least as effective as the dispensing system disclosed in Peterson.

Other toothpaste tubes and toothpaste dispensing systems are shown in U.S. Pat. No. 4,997,107, issued on Mar. 5, 1991 to Walter F. Snyder et al. (a disposable grease tube having a key member at its end to effect a winding and pressurizing of the body, and a matrix of roughened projections or suction cups cast with the tube); U.S. Pat. No. 5,732,854, issued on Mar. 31, 1998 to Robert M. Reuben (a device, method and system for controlling the volume of collapsible tubes comprising a tab strip attached to the tube bottom, the tab ends including hook and loop fastening patches for engaging each other when the tube is rolled up); U.S. Patent Publication No. 2001/0040172, published on Nov. 15, 2001 (a toothpaste tube roll-up retainer device comprising a bendable strip having a pair of parallel spaced bendable wires molded with the strip and attached to the end of the tube to overlap and fold over the tube as it is being rolled up); U.S. Pat. No. 4,807,782, issued on Feb. 28, 1989 to Wesley C. Meinerding et al. (a contents-saver plastic dispensing tube comprising a rubber band or an overlapping metal clasp strip attached to the bottom end of a toothpaste tube); and U.S. Pat. No. 5,082,144 issued on Jan. 21, 1992 to Clinton J. Sundstrom (a reusable retainer clip for a flexible tube comprising a rectangular body having a slot for insertion of the sealed tube end, and includes a rotatable holder on each side adapted for gripping and holding folded flat segments of the tube).

Still other tube dispenser devices are shown in U.S. Pat. No. 5,442,839, issued on Aug. 22, 1995, to George C. Miller (a control clip for use with a toothpaste tube comprising a resilient clip in the form of an inwardly depending front member with a lip, and a bottom element having an outwardly flared portion); U.S. Pat. No. 5,782,385, issued on Jul. 21, 1998 to Min T. Soon (a tube squeezer comprising a block device having upper and lower mating parts that slide up on the tube); U.S. Pat. No. 5,884,812, issued on Mar. 23, 1999 to Jan-Piotr Stawowski (a tube squeezer comprising a three-part tube squeezer having an elliptically shaped housing, a shaft rotatably mounted in the housing, and a longitudinal slot to receive the end of a tube and wind the tube therearound, a key outside the housing on an end of the shaft for winding the shaft, and a removable friction-fit or threaded locking piece on the opposite shaft end outside the housing for holding the structure in assembly); U.S. Pat. No. 5,920,967, issued on Jul. 13, 1999 to Augustine Souza (a combination holder and squeezing device for tube dispensers comprising a cylindrical metal barrel portion having a pair of planar plates extending therefrom); U.S. Pat. No. 6,415,479, issued on Jul. 9, 2002 to Nathan Steinberg (a permanently affixed or removable clip for squeezing tubes comprising an elongated clip having foldable wings folded about the tube allowing the user to hold the folded position); International Patent No. WO 86/01178 published on Feb. 27, 1986 (a device for winding up collapsible tubes comprising a base or mandrel having a slot for the tube, and a pivoting handle for holding the rolled up tube from unrolling); and Japanese Patent No. 8-3832, published on Feb. 13, 1996 (a device for attaching or detaching the cap of a toothpaste tube comprising a clamping device having a cam to push the cap up, rotate it, and automatically attach the cap).

None of the above inventions and patents, taken either singly or in combination, is seen to describe the instant invention as claimed. Thus, a toothpaste dispensing system to aid in using toothpaste tubes solving the aforementioned problems is desired.

SUMMARY OF THE INVENTION

The present invention is a toothpaste dispensing system, including a toothpaste tube and a pair of mating hook and loop fastening strips affixed to opposing surfaces of the toothpaste tube. When the bottom end of the tube is rolled up to dispense toothpaste, the mating hook and loop strips from opposing tube surfaces interlock. Consequently, the emptied, folded portions of the tube are held together, facilitating efficient dispensing of the toothpaste.

Accordingly, it is a principal object of the invention to provide a means to maintain a toothpaste tube being used in a compact rolled up form.

It is another object of the invention to provide a toothpaste tube with attached or attachable longitudinal hook and loop strips.

It is a further object of the invention to provide a toothpaste tube with hook and loop strips on opposite sides of the tube.

It is an object of the invention to provide improved elements and arrangements thereof for the purposes described which is inexpensive, dependable and fully effective in accomplishing its intended purposes.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
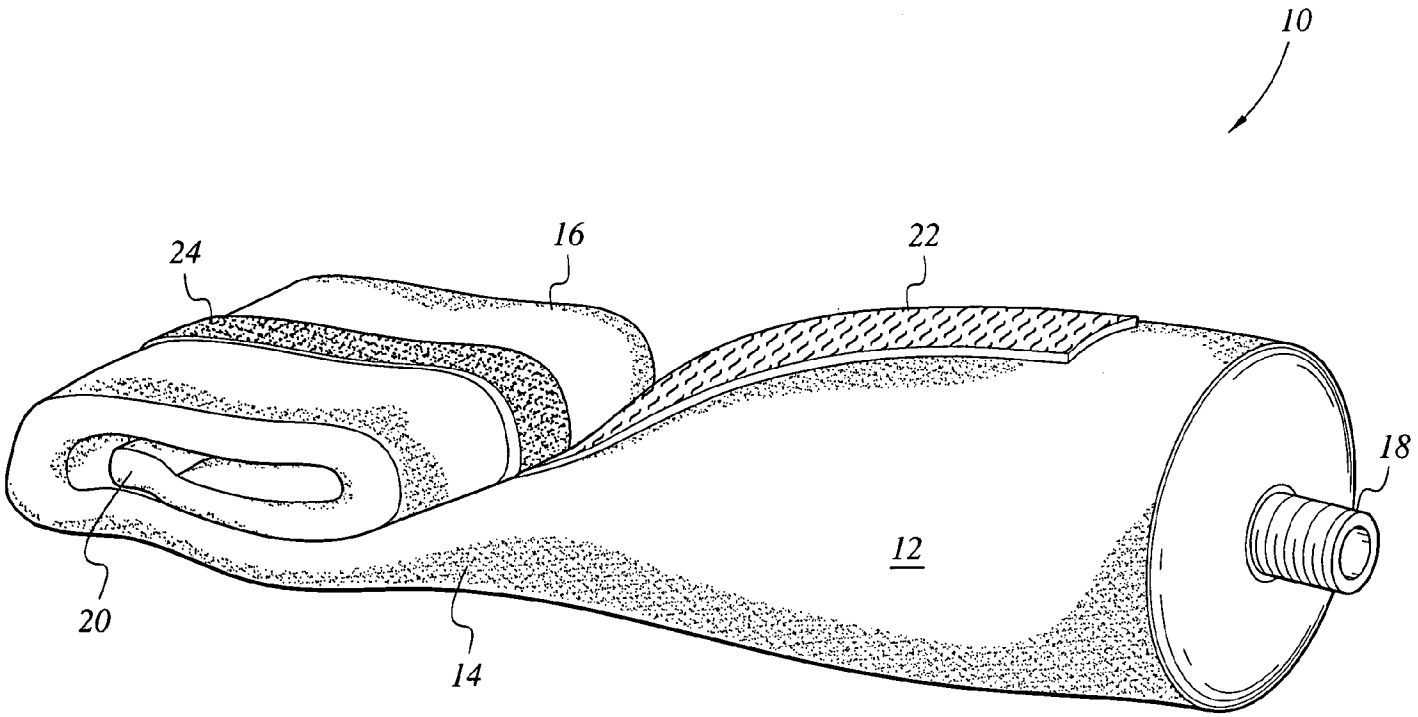
FIG. 1 is an environmental, perspective view of a toothpaste dispensing system according to the present invention, showing the toothpaste tube and hook and loop strips on opposite sides of the toothpaste tube.
Figure 2:
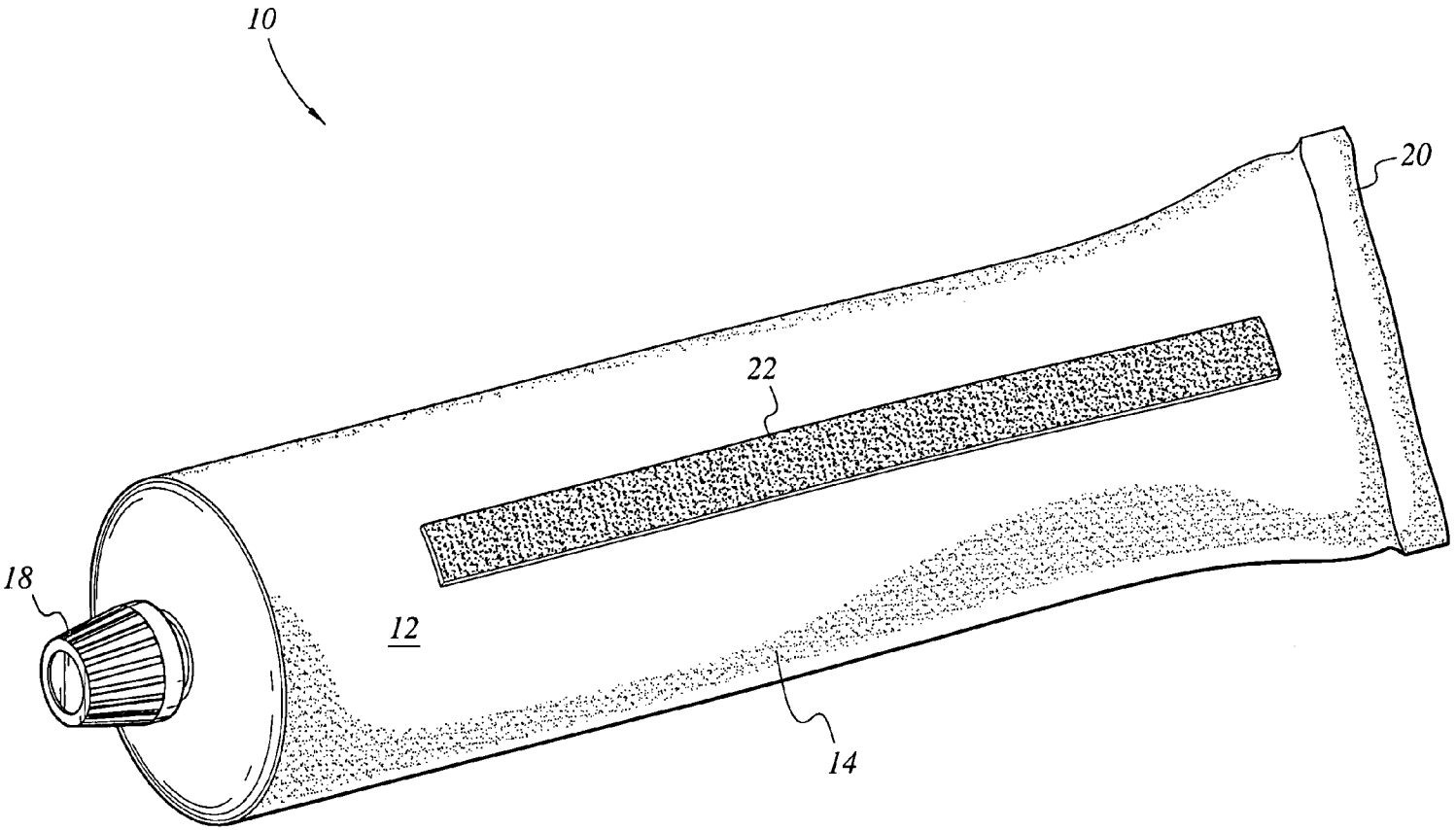
FIG. 2 is a perspective side view of the toothpaste dispensing system according to the present invention, showing a first side of the toothpaste tube and a longitudinal strip of hook and loop material affixed thereto.
Figure 3:
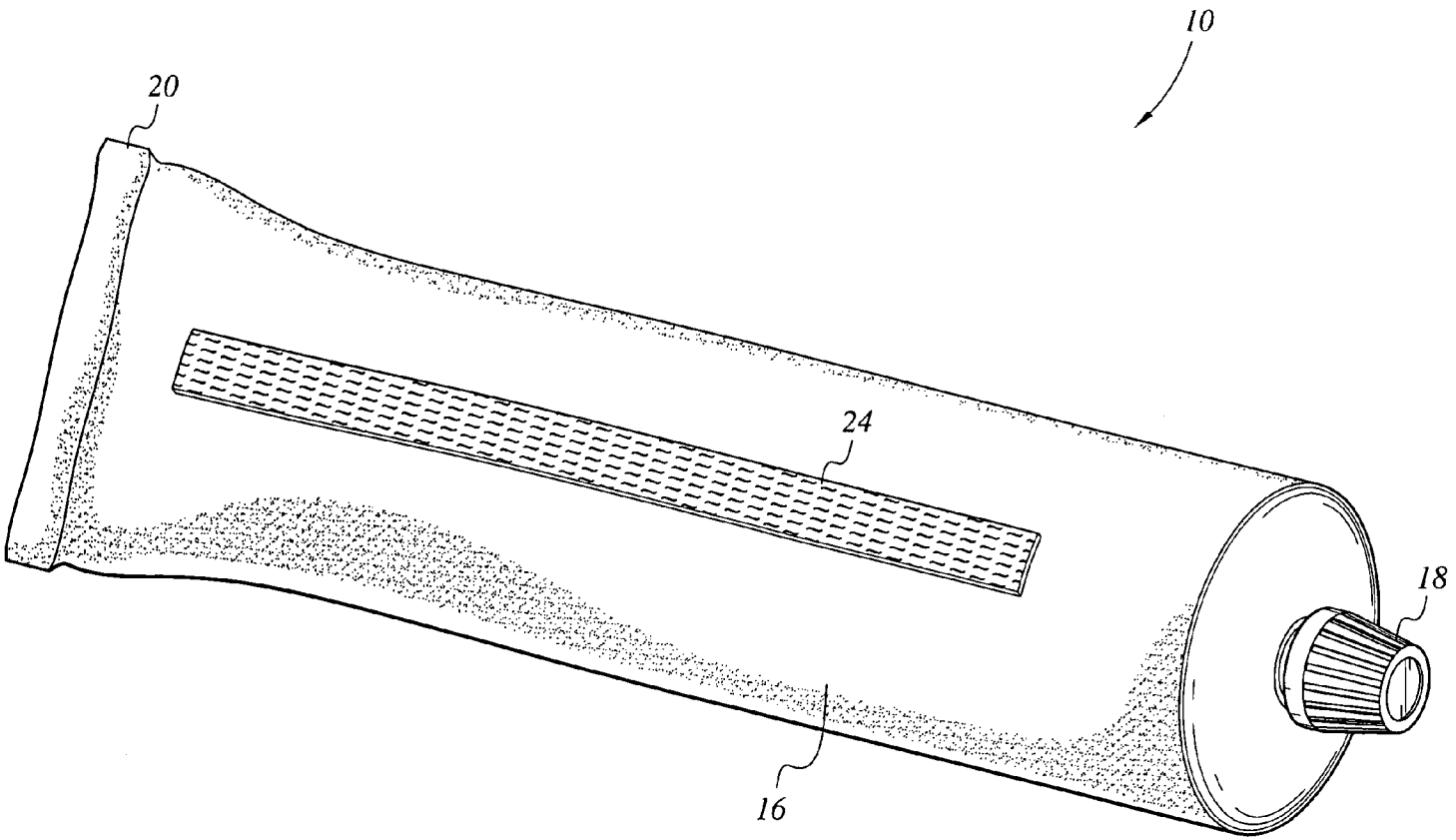
FIG. 3 is a perspective side view of the toothpaste dispensing system according to the present invention, showing a second side of the toothpaste tube and a longitudinal strip of hook and loop material affixed thereto.

The present invention is directed to a toothpaste dispensing system generally designated as 10 in the drawings. The system 10, includes a toothpaste tube 12, having opposing first and second sides, 14 and 16 respectively. The tube 12 further includes a nozzle end 18 and a sealed bottom end 20. A pair of mating hook and loop fastener strips, 22 and 24, are affixed to the first and second sides, 14 and 16 respectively. As the toothpaste is used, the bottom end 20 is rolled up to force the toothpaste towards the nozzle end 18. The hook and loop strips, 22 and 24, respectively, engage one another upon coiling of the tube 12 and effectively maintain the rolled configuration of the tube 12 as depicted in FIG. 1.

The hook and loop strips 22 and 24 can be of any suitable dimension. Preferably, however, the strips 22 and 24 should have a length sufficient to extend approximately along the length of the tube 12 and a width large enough to hold the tube surfaces 14 and 16 together and still allow sufficient room for a user to grasp the tube surface on either side of the strips, 22 and 24 when coiling the bottom end 20 of the tube 12. For most conventional tubes for example, the hook and loop strips, 22 and 24 should be 0.25 inch wide and approximately 4 to 4.5 inches long. The strips, 22 and 24, can be disposed any suitable distance from the bottom end 20. Preferably, one or both of strips 22 and 24 should be disposed one inch away from the bottom end 20.

The hook and loop strips, 22 and 24 may be permanently attached to the toothpaste tube 12 by the manufacturer, or the strips 22 and 24 may be removably attached to the tube 12 so that the strips 22 and 24 may be re-used by the consumer on another tube of toothpaste. The strips 22 and 24 can be affixed to the tube surface by any suitable adhesive. Preferably, the adhesive is one that allows for repeated removal and adherence of the strips, 22 and 24, such as an epoxy cement. The surface of the tube 12 should be clean and dry when applying the hook and loop strips, 22 and 24. It has been found that this device is fully effective in maintaining the coiled state of the toothpaste tube 12.

It is to be understood that the present invention is not limited to the embodiment described above, but encompasses any and all embodiments within the scope of the following claims.

I claim:

1. A toothpaste dispensing system, consisting of:

a flexible tube adapted for containing toothpaste and having a nozzle end, an opposing sealed bottom end, and opposing first and second sides extending between and connecting the nozzle end and the bottom end;

said first and second sides each defining a length between said nozzle end and said bottom end;

a first continuous hook material fastener strip being permanently affixed to said first side along the length thereof;

a second continuous loop material fastener strip being permanently affixed to said second side along the length thereof;

wherein said hook material fastener strip and said loop material fastener strip engaging each another when rolling said bottom end toward said nozzle end, and said hook material fastener strip and said loop material fastener strip are approximately 0.25 inch wide;

whereby toothpaste contained in said tube is selectively forced out of said nozzle end, and said tube in prevented from unrolling.

2. A toothpaste dispensing system, consisting of:

a flexible tube adapted for containing toothpaste and having a nozzle end, an opposing sealed bottom end, and opposing first and second sides extending between and connecting the nozzle end and the bottom end;

said first and second sides each defining a length between said nozzle end and said bottom end;

a first continuous hook material fastener strip being removably affixed to said first side along the length thereof;

a second continuous loop material fastener strip being removably affixed to said second side along the length thereof;

wherein said hook material fastener strip and said loop material fastener strip engaging each another when rolling said bottom end toward said nozzle end, and said hook material fastener strip and said loop material fastener strip are approximately 0.25 inch wide;

whereby toothpaste contained in said tube is selectively forced out of said nozzle end, and said tube in prevented from unrolling.

* * * * *